United States Patent [19]

Kretchman

[11] Patent Number: 5,066,050

[45] Date of Patent: Nov. 19, 1991

[54] DRYER TRANSITION DUCT

[75] Inventor: Gerald L. Kretchman, St. Joseph Township, Berrien County, Mich.

[73] Assignee: Whirlpool Corporation, Benton Harbor, Mich.

[21] Appl. No.: 599,518

[22] Filed: Oct. 18, 1990

Related U.S. Application Data

[62] Division of Ser. No. 354,748, May 22, 1989, Pat. No. 4,989,347.

[51] Int. Cl.[5] ..... F16L 39/00

[52] U.S. Cl. ..... 285/319; 285/419; 138/162; 34/133; 34/235

[58] Field of Search ..... 34/235, 133, 82; 138/162, 163, 128, 156, 166; 285/319, 320, 325, 321, 373, 419

[56] References Cited

U.S. PATENT DOCUMENTS

| | | | |
|---|---|---|---|
| 777,552 | 12/1904 | Smith | 138/162 X |
| 2,505,631 | 4/1950 | Webster . | |
| 2,964,851 | 12/1960 | Stelljes et al. . | |
| 3,648,381 | 3/1972 | Fox . | |
| 4,033,047 | 7/1977 | Kawai . | |
| 4,091,546 | 5/1978 | Bochan . | |
| 4,123,093 | 10/1978 | Newland | 285/319 X |
| 4,467,534 | 8/1984 | Murase . | |
| 4,638,573 | 1/1987 | Nakamura et al. . | |
| 4,667,702 | 5/1987 | Roth | 138/162 |
| 4,720,925 | 1/1988 | Czech et al. . | |

*Primary Examiner*—Albert J. Makay
*Assistant Examiner*—John Sollecito
*Attorney, Agent, or Firm*—Hill, Van Santen, Steadman & Simpson

[57] ABSTRACT

A transition duct assembly for a dryer air handling system, connecting a lint duct assembly to a blower housing includes two duct pieces assembled together with locking tabs and a tongue and groove arrangement at the longitudinal seams of the two duct pieces, a sealing ring and spring clip at the transition duct assembly/-blower housing interface, and a simple one screw attachment arrangement at the transition duct assembly/-lint duct assembly interface. The transition duct assembly provides an air sealed assembly which is accessible to assemble and disassemble from behind the front panels of the appliance, prevents sound and vibration transmission through the transition duct assembly, and minimizes hand tool work to assemble or disassemble the transition duct and the air handling system.

13 Claims, 3 Drawing Sheets

FIG. 5
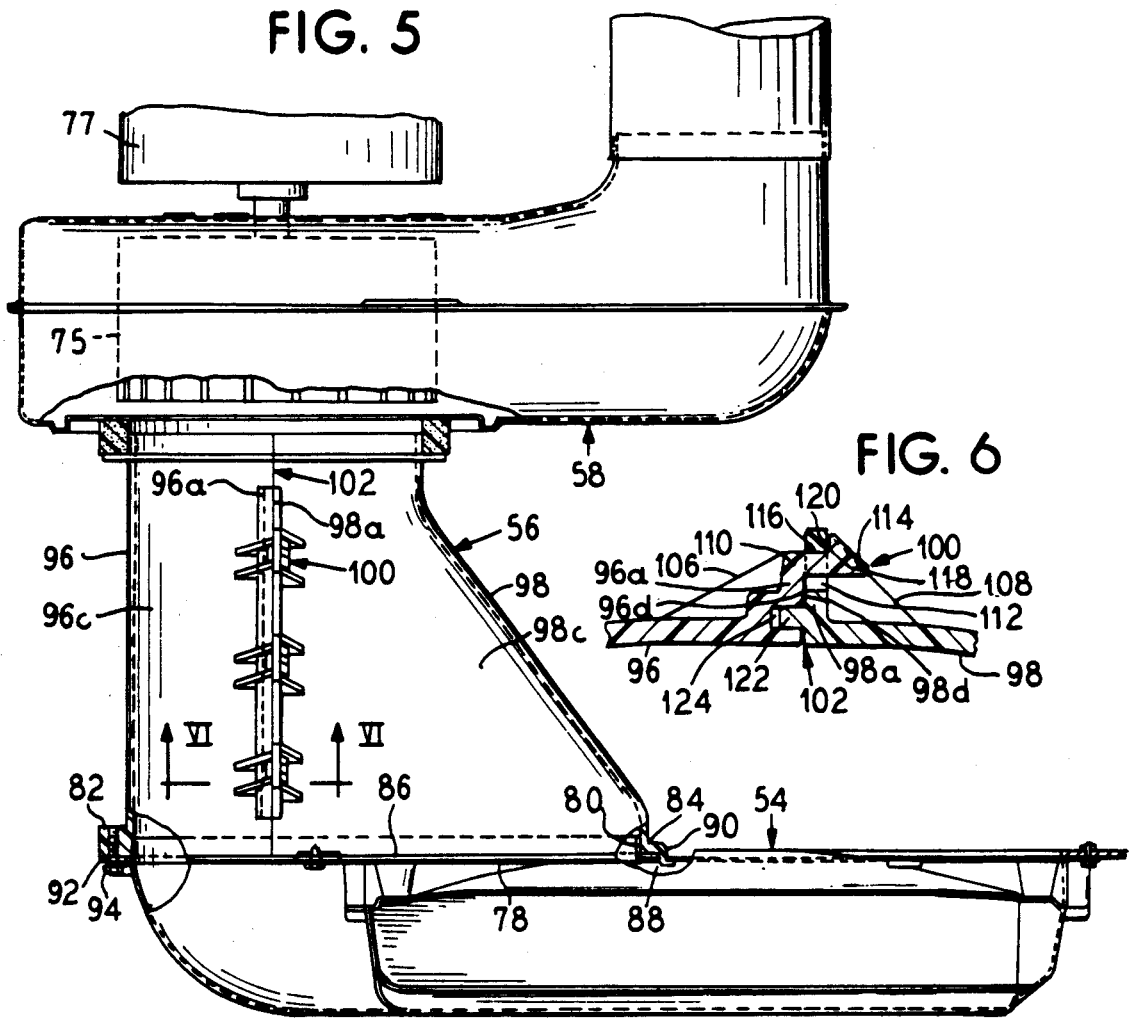
FIG. 6
FIG. 7
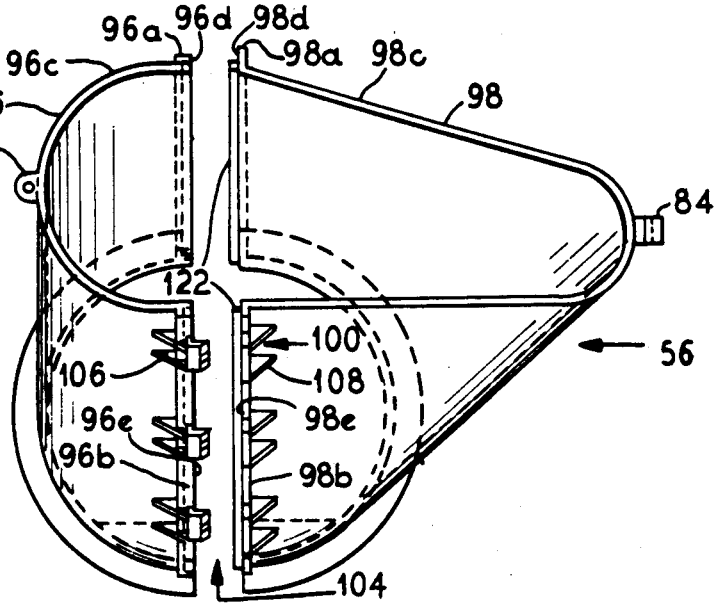

DRYER TRANSITION DUCT

This application is a divisional application of Ser. No. 354,748 "Dryer Transition Duct," filed 5/22/89, now U.S. Pat. No. 4,989,347.

BACKGROUND OF THE INVENTION

This invention relates generally to domestic appliances and more particularly to a domestic clothes drying machine or dryer. Specifically, this invention relates to a transition duct assembly for an appliance air handling system.

In a dryer, air moves through a drum containing clothing and exits through a lint duct assembly where clothing lint is captured by a screen or filter. Once through the lint screen assembly, the air passes into the transition duct assembly. The transition duct assembly, which is the particular subject of this patent, directs air from a dryer lint filter assembly to a dryer blower housing, where a blower moves the air through an exhaust duct and out of the dryer.

U.S. Pat. No. 4,720,925 discloses a lint filter housing for a dryer. A lint filter duct directs air from a lint filter to a blower. The lint filter duct is made of two halves which are crimped together. The lint filter duct is attached to a lint filter housing by two screws.

U.S. Pat. No. 2,964,851 discloses a dryer lint trap which includes a two piece discharge duct between a lint trap and a blower housing. The discharge duct is formed from two halves which are spot welded together along a flange. The discharge duct is mounted to the dryer structure with screws.

U.S. Pat. No. 3,648,381 discloses a dryer which has a closed air duct between a lint duct and a blower. However, no details of the closed air duct structure or mounting are provided.

U.S. Pat. No. 4,638,573 discloses a dryer which has a closed air duct between a lint screen and an exhaust blower. No details of the closed air duct structure or mounting are apparent from the drawings or from the specification.

U.S. Pat. No. 4,467,534 discloses a dryer which has a two piece duct which contains a fan and heating element. The details of the duct construction and mounting are not clear from the drawings or from the specification.

U.S. Pat. No. 4,091,546 discloses a dryer which has a closed air duct between a lint filter and a condenser/-blower housing. The duct appears to be an assembly of two halves, however the details of the duct construction and mounting are not clear from the drawings or from the specification.

SUMMARY OF THE INVENTION

The subject of this invention relates to a transition duct assembly which mounts between two components in an appliance air handling system. This invention is preferably embodied in an axial air flow dryer, where air flows into a drying drum at one end wall or bulkhead and out the drying drum at an opposite end wall or bulkhead, but could be embodied in a non-axial air flow dryer as well. The preferred embodiment of this invention relates to a vertically stacked washer and dryer appliance, but could be embodied in an independent dryer or other appliance as well.

It is an object of the invention to provide a sealed air transition duct assembly for a domestic appliance which:

1. requires minimal labor and minimal hand tool work to assemble and install;
2. can be assembled and disassembled by access through front panels of the machine;
3. is isolated from the sound and vibration of the blower housing; and
4. maintains an air sealed integrity throughout the transition duct assembly.

In a transition duct assembly as initially described these objectives are accomplished in that:

1. the transition duct assembly is assembled and installed using six self-locking tabs, one molded tab and one screw;
2. access to the transition duct requires removal of front panels only;
3. the sealing ring and the spring clip maintain a clearance between the transition duct assembly and the blower housing assembly, providing a sound and vibration isolator which prevents sound and vibration from being transmitted from the blower housing through the transition duct assembly to other components of the appliance;
4. the transition duct assembly comprises two duct pieces which snap together using a tongue and groove arrangement and six locking tabs which provide longitudinal sealing of the transition duct assembly seams. Also, the transition duct assembly is sealed to both a lint screen housing at one end and to the blower housing at another end, providing air tightness at both ends of the transition duct assembly.

BRIEF DESCRIPTION OF THE DRAWINGS

FIG. 5 is a plan view partially in section showing the dryer air handling system components: the lint duct assembly, the transition duct assembly, and the blower housing.

FIG. 6 is an enlarged sectional view generally along line VI—VI of FIG. 5 showing the longitudinal seam assembly of the transition duct assembly.

FIG. 7 is a front elevational view of the transition duct assembly as shown in FIG. 5, but before being assembled.

DETAILED DESCRIPTION OF THE PREFERRED EMBODIMENTS

Figure 1:
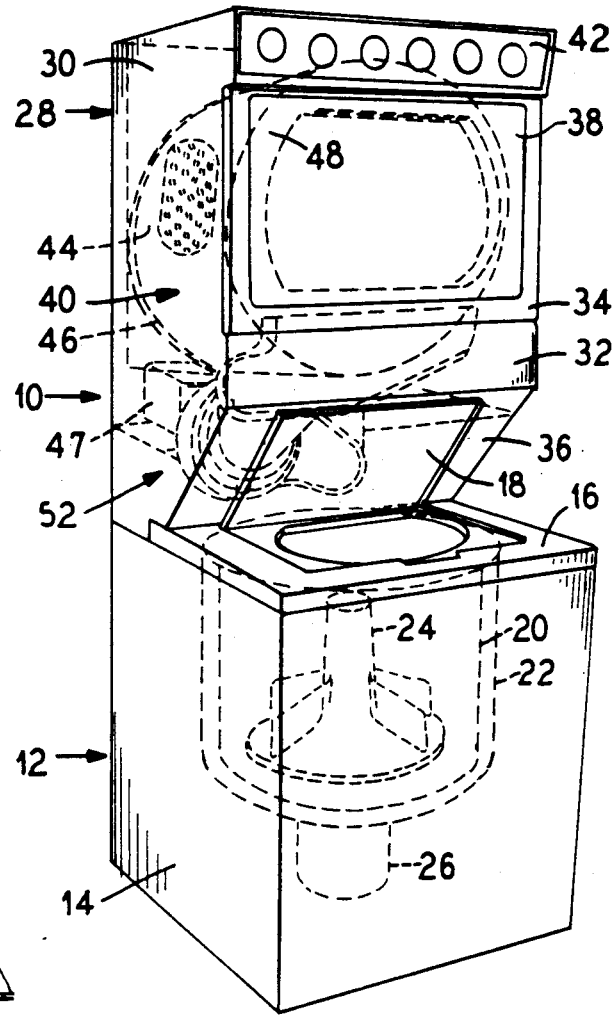
FIG. 1 is a perspective view of a dryer mounted above a washer showing the external appearance of the appliance cabinetry, and appliance internal components in phantom.

In FIG. 1 there is illustrated a combined washer/dryer appliance at 10 comprising a clothes washing machine or washer generally at 12 which has a cabinet formed of side panels 14 and a top panel 16. In the top panel 16 there is a hinged access door 18 which provides access for placing clothes into the interior of the washer wherein a wash basket 20 is concentrically mounted within a wash tub 22. A vertical axis agitator 24 is carried within the wash basket 20 and is selectively driven by an electric motor 26 to perform the washing operation.

A dryer 28 is mounted in a vertical relationship above the washer 12. The dryer 28 has a cabinet with side panels 30 and front panels 32, 34 and 36. Front panel 34 has a hinged door 38 which provides access to the interior of a drum 40 in which the clothes are to be placed for drying. Controls 42 are provided on a front of the appliance 10 through which the user can operate the washer and dryer. The drum 40 is comprised of a stationary rear wall or bulkhead 44 having air inlet openings 45 therethrough, an imperforate rotatable annular wall 46, and a stationary front wall or bulkhead 48. The annular wall 46 is rotated by an electric motor means 47. Front wall 48 has an opening therein providing access to the interior of the drum 40, and an opening to receive an air grill 50 (shown in FIG. 3) for air circulation through the drum. An air handling system shown generally at 52 draws air into the dryer through openings (not shown) in the dryer cabinet. The air is drawn past a heater (not shown) where the air is selectively heated, and into the drum 40 through the inlet openings 45 in the rear wall 44. The air handling system 52 draws moist air out of the drum 40 through the air grill 50 and into lint duct assembly 54 (shown in FIGS. 2, 3, 5) which houses a lint screen 62.

Figure 2:
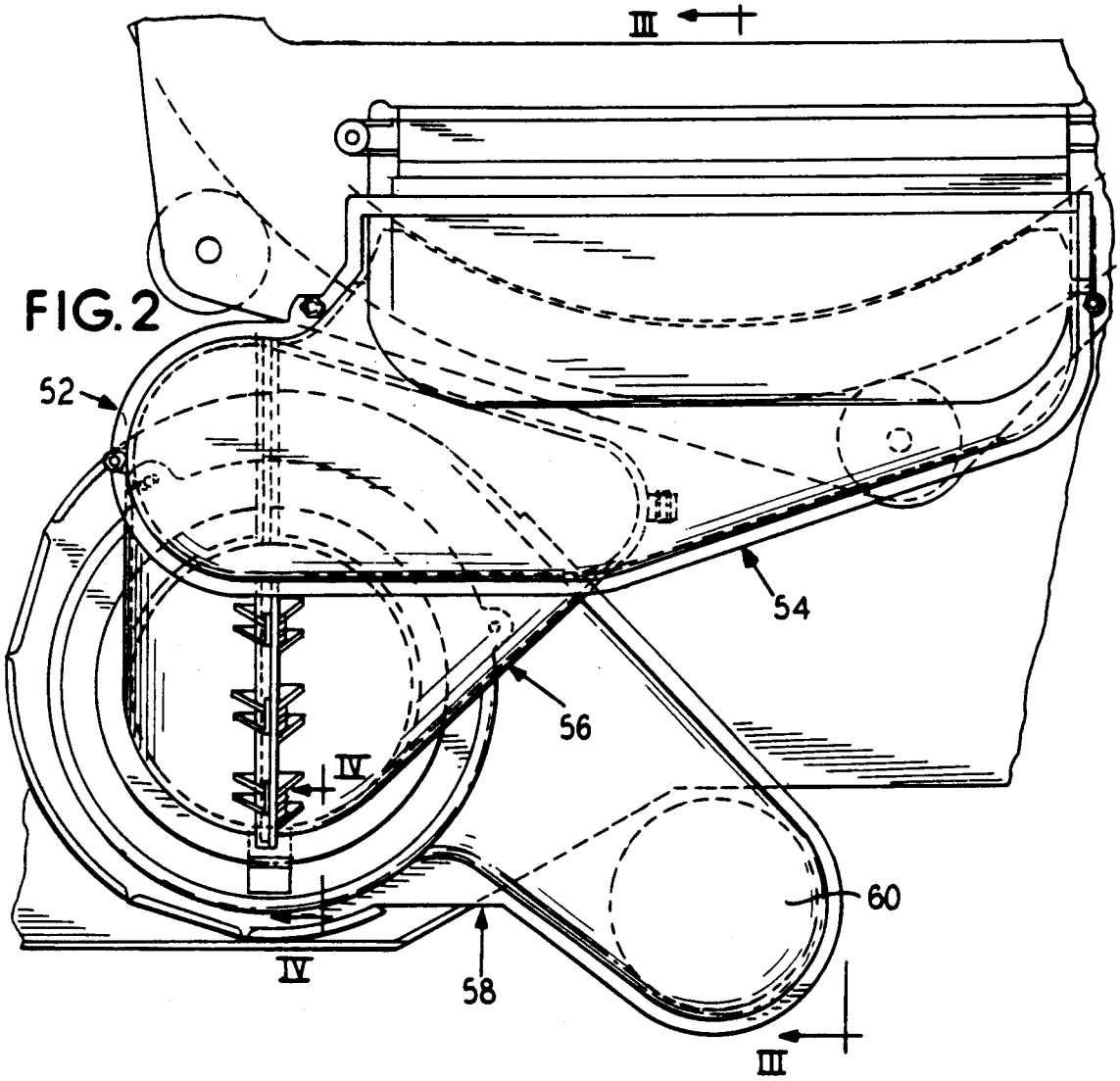
FIG. 2 is an enlarged front elevation view (with cabinetry removed) of dryer air handling system components shown in FIG. 1: a lint duct assembly, a transition duct assembly, and a blower housing.

FIG. 2 shows an enlarged elevation of the dryer air handling system 52. Major components shown are: the lint duct assembly 54, a transition duct assembly 56, a blower housing assembly 58, and an air exhaust duct 60 (shown dashed).

Figure 3:
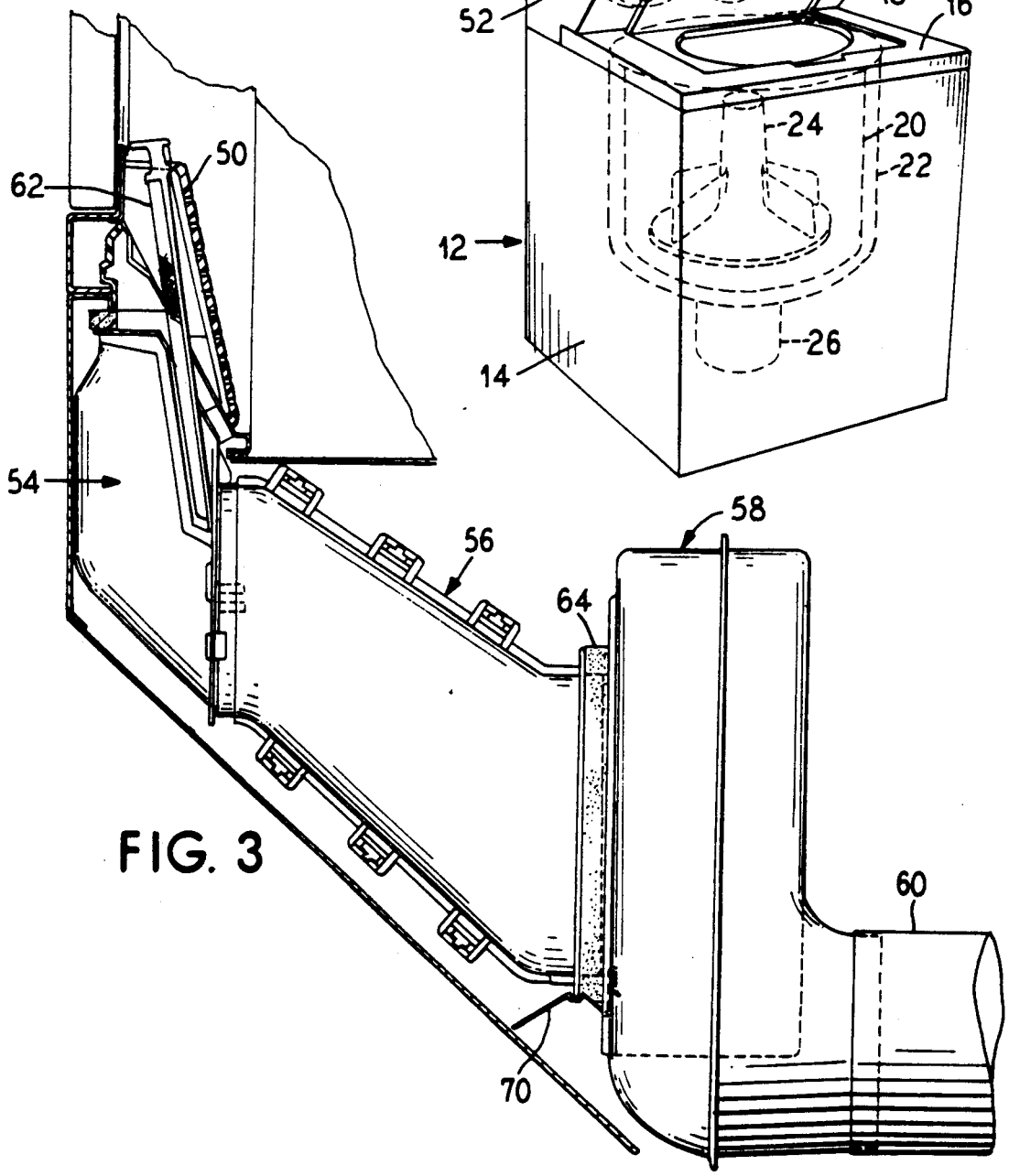
FIG. 3 is a sectional view generally along line III—III of FIG. 2 showing the components of the dryer air handling system.

FIG. 3 is a section generally along line III—III of FIG. 2. FIG. 3 shows the transition duct assembly 56 mounted to the blower housing assembly 58 and to the lint duct assembly 54. Moist air moves from inside drum 40 through air grill 50, then through lint screen 62 and lint duct assembly 54, then through transition duct assembly 56, then through blower housing 58, and finally the air exits the dryer via air exhaust duct 60. The air is moved by a blower 75 (shown in FIG. 5) mounted in blower housing 58.

Figure 4:
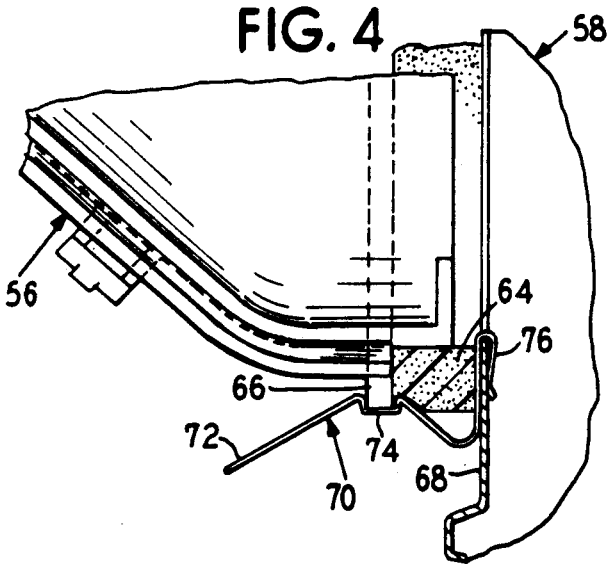
FIG. 4 is an enlarged sectional view generally along line IV—IV of FIG. 2, showing an attachment of the transition duct assembly to the blower housing.

FIG. 4, an enlarged section generally along line IV—IV of FIG. 2, shows a seal arrangement between the transition duct assembly 56 and the blower housing 58. A sealing ring 64 is installed around a perimeter of the transition duct assembly 56 and against a recessed flange or molded collar 66 thereof and compressed against a mating surface panel 68 of the blower housing 58 when the transition duct assembly is mounted to the blower housing, forming a sealed connection.

A spring clip 70, clipped to the mating surface panel 68 of the blower housing 58, engages the molded collar 66 when the transition duct assembly is mounted to the blower housing 58. The spring clip 70 is bent from a one-piece flat spring steel strip. The spring clip comprises a leading edge portion 72 which guides the transition duct assembly 56 into alignment with the blower housing 58 as the transition duct assembly approaches the blower housing during assembly. A recess or detent portion 74 of the spring clip 70 receives and engages the molded collar 66 and fixes a clearance or spacing between the transition duct assembly and the blower housing preventing the transition duct assembly from approaching the blower housing any closer than said clearance during assembly. A hairpin clip portion 76 of spring clip 70 removably fastens the spring clip 70 to the blower housing mating surface panel 68.

To disassemble the transition duct assembly 56 from the blower housing 58, the leading edge portion 72 is elastically depressed in a direction away from the transition duct assembly 56 to release the molded collar 66 from the recess 74.

The spring clip 70 insures accurate alignment of the transition duct assembly 56 to the blower housing 58. Also, the spring clip 70 and the sealing ring 64 maintain clearance between the transition duct assembly 56 and the blower housing 58, and act as a sound and vibration isolator, preventing the transmission of sound and vibration from the blower housing 58 through the transition duct assembly 56 to other components of the dryer 28.

FIG. 5 shows the transition duct assembly 56 mounted to the blower housing 58 and also mounted to the lint duct assembly 54. The blower 75 mounted inside blower housing 58 is shown connected to a blower driver or motor 77. The blower 75 acts to move air through the air handling system 52.

FIG. 5 details a connection between the transition duct assembly 56 and the lint duct assembly 54. Lint duct assembly 54 further comprises a mating surface wall 78 and a mating lip 80. Transition duct assembly 56 further comprises a molded screw lug 82, a molded tab 84, and a sealing surface 86. The lint duct assembly mating lip 80 is mortised into the transition duct assembly 56 insuring a precise and secure fit.

The lint duct assembly is further secured to the transition duct assembly by engaging the molded tab 84 of the transition duct assembly into a slot 88 in the mating surface wall 78 of the lint duct assembly. The molded tab 84 includes an L-shaped catch mechanism 90 which engages an inside surface of mating surface wall 78 and prevents linear withdrawal of the transition duct assembly 56 from the lint duct assembly 54 after the transition duct assembly 56 and the lint duct assembly 54 are assembled. A seal or gasket 92 is installed circumferentially around the air opening 93 in the sealing surface 86 between the sealing surface 86 of the transition duct assembly and the mating surface wall 78 of the lint duct assembly. A single screw 94 is then installed through the mating surface wall 78 and engaged into the molded screw lug 82. As screw 94 is drawn tight, the seal or gasket 92 is compressed between the sealing surface 86 and the mating surface wall 78 achieving a sealed connection between the transition duct assembly 56 and the lint duct assembly 54. Thus, assembling transition duct assembly 56 to lint duct assembly 54 and blower housing 58 requires only one screw, which minimizes hand tool work for both assembly and disassembly of the air handling system. The screw 94 can be accessed by removing front panels 32 and 36 of the dryer cabinet.

A method of assembling the transition duct assembly is shown in FIG. 5. The transition duct assembly comprises two pieces: a left-hand U-channel shaped duct piece 96 and a right-hand U-channel shaped duct piece 98. The left-hand duct piece 96 and the right-hand duct piece 98 are assembled together using three self-locking engagement means comprising locking tabs shown generally at 100 on one longitudinal seam 102, and identical three locking tabs 100 on an opposite longitudinal seam 104 (shown in FIG. 7). The duct pieces 96 and 98 each have a pair of opposed leg portions 96A, 96B, 98A, 98B connected to an arcuate bight portion 96C, 98C.

FIG. 6 is a sectional view generally along line VI—VI of FIG. 5 showing an arrangement of the locking tabs 100, and the longitudinal seam 102. Locking tab 100 comprises a latch member 106 fixed to left-hand duct piece 96, and a receiver member 108 fixed to right-hand duct piece 98. A latch shaft 110 is inserted through a slot 112 in receiver member 108, and while being inserted, an inclined or ramped edge 114 of the latch shaft 105, in contact with an edge 116 of slot 112, elastically depresses latch shaft 110 toward the transition duct assembly. When latch shaft 110 is fully inserted into slot 112, inclined edge 114 passes through slot 112 and is no longer in contact with edge 116. Therefore, latch shaft 110 is free to elastically spring back away from the transition duct assembly, and a trailing edge 118 of latch shaft 110, perpendicular to the length of the shaft 110, opposes an upper slot surface 120, perpendicular to sidewalls defining the slot, such opposition prohibiting withdrawal of the latch member 106 from the receiver member 108. When all six locking tabs 100 are engaged, left-hand duct piece 96 and right-hand duct piece 98 are assembled together. Disassembly requires that latch shaft 110 be depressed toward the transition duct assembly until trailing edge 118 clears upper slot surface 120 permitting the latch shaft 110 to be withdrawn. These locking tabs 100 provide an efficient, simple means of assembling and disassembling the transition duct assembly 56 without need for heat sealing, solvent bonding, or hand tool work.

FIG. 6 also shows a tongue and groove construction of the longitudinal seam 102. The longitudinal seam 104 is similar (FIG. 7). The right-hand duct piece 98 comprises a projecting longitudinal bar or tongue 122 formed at a free edge 98D, 98E of the legs 98A, 98B and the left-hand duct piece 96 comprises a longitudinal channel or groove 124 formed at a free edge 96D, 96E of the legs 96A, 96B. The tongue 122 mates with or engages into the groove 124 when the right-hand duct piece 98 and the left-hand duct piece 96 are assembled together. The tongue and groove arrangement makes longitudinal seams 102 and 104 sealed connections in that a labyrinth type seal is thus formed between the two duct pieces 96, 98. Also, the tongue and groove arrangement provides proper alignment of left-hand duct piece 96 and right-hand duct piece 98 for engagement of the six locking tabs 100.

The transition duct assembly 56 comprises left-hand duct piece 96 and right-hand duct piece 98 is shown disassembled in elevational view in FIG. 7. Three locking tabs 100 which engage to assemble the longitudinal seam 104 are shown, unengaged. The two tongues 122, which participate in the tongue and groove arrangement for longitudinal seams 102 and 104, are also shown.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonable and properly come within the scope of my contribution to the art.

The embodiments of the invention in which an exclusive property or privilege is claimed are defined as follows:

1. A duct for use in an air handling system comprising:

a pair of U-channel shaped members, each member having a pair of leg portions connected by an arcuate bight portion, each of said leg portions opposed to a respective corresponding leg portion on the respective opposite member, said pair of leg portions extending perpendicularly from said arcuate bight portion;

a free edge of each leg portion of one of said U-channel shaped members being configured so as to mate with an opposing free edge of a leg member of the other of said U-channel shaped members such that the two U-channel shaped members can be united as a unit forming a central passage enclosed by a circumferential wall;

self-locking engagement means integrally formed on one U-channel shaped member, adjacent said free edges thereof, arranged to engage with opposing compatible self-locking engagement means on a respective other of said U-channel shaped members, for locking said U-channel shaped members together, when pressed together with said free edges in mating engagement wherein said free edges on one of said U-channel shaped members have a projecting tongue portion and said free edges on the other of said U-channel shaped members have a mating groove portion, said projecting tongue portion and said mating groove portion oriented to be interengaged when said U-shaped members are pressed together.

2. A duct according to claim 1, wherein said self-locking engagement means comprise a plurality of resilient tabs on one of said U-channel shaped members and a plurality of receiver members on the other of said U-channel shaped members, said tabs engaging and locking with said receiver members upon insertion of said tabs into said receiver members.

3. A duct according to claim 1, wherein said duct includes a sealing member at one end thereof to permit sealing engagement between said U-channel shaped members and a further component of said air handling system.

4. A duct according to claim 3, wherein said sealing member surrounds said U-channel shaped members and extends past an end of said U-channel shaped members; and said duct includes an annular collar surrounding said U-channel shaped members and abutting said sealing member.

5. A duct according to claim 1, wherein said self-locking engagement means comprise a plurality of resilient tabs on one of said U-channel shaped members and a plurality of receiver members on the other of said U-channel shaped members, said tabs engaging and locking with said receiver members upon insertion of said tabs into said receiver members.

6. A duct according to claim 5, wherein an end of said duct includes a sealing member to permit sealing engagement between said U-channel shaped members and a further component of said air handling system.

7. A duct according to claim 6, wherein said sealing member surrounds said U-channel shaped members and extends past an end of said U-channel shaped members; and said duct includes an annular collar surrounding said U-channel shaped members and abutting said sealing member.

8. A duct according to claim 7, wherein an opposite end of said unitary duct provides a screw holding mounting tab and a hook-shaped fastening lug to permit removable engagement between said duct and a further component of said air handling system.

9. A duct according to claim 2, wherein said resilient tabs comprise latch shafts extending perpendicularly from a first respective leg portion; and said receiver members comprise apertures formed through a second opposed leg portion, said latch shaft insertable and engageable through said aperture to resiliently clamp said first leg portion and said second leg portion together.

10. A duct according to claim 9, wherein one of said first and second leg portions has formed thereinto a groove extending the length of said opposed leg portion, and said respective other of said first and second leg portions has formed thereon an extending tongue portion, and when said resilient tab and said receiver member act to clamp said first and second leg portions together, said tongue is arranged to tightly interfit into said groove.

11. A duct according to claim 9, wherein said latch shaft comprises at a distal end an inclined surface and a trailing edge, said inclined surface causes said latch shaft to deflect when said latch shaft passes into said aperture, and said latch shaft is fashioned to resiliently spring back, causing said trailing edge to abut a backside of said receiver member to resist disengagement of said resilient tab from said receiver member.

12. A duct according to claim 9, wherein said first and second leg portions, in the vicinity of said tabs and said receiver members, comprise a plurality of triangular reinforcing gussets stiffening said resilient tabs and said receiver members against said arcuate bight portions.

13. A duct for use in an air handling system comprising:

a pair of U-channel shaped members, each member having a pair of leg portions, opposed to a respective corresponding leg portion on the respective other U-channel shaped member, said pair of leg portions connected by an arcuate bight portion;

a free edge of each leg portion of one of said U-channel shaped members being configured so as to mate with an opposing free edge of a leg member of the other of said U-channel shaped members such that the two U-channel shaped members can be united as a unit forming a central passage enclosed by a circumferential wall;

self-locking engagement means integrally formed on one U-channel shaped member, adjacent said free edges thereof, arranged to engage with opposing compatible self-locking engagement means on a respective other of said U-channel shaped members, for locking said U-channel shaped members together as a unitary duct, when said U-channel shaped members are pressed together with said free edges in mating engagement, wherein an end of said duct includes a mounting tab and a fastening lug to permit removable engagement between said duct and a further component of said air handling system.

* * * * *